US007632998B1

(12) United States Patent
Morrison

(10) Patent No.: US 7,632,998 B1
(45) Date of Patent: Dec. 15, 2009

(54) ASSEMBLY FOR PURGING LIQUID FROM A LIP VIBRATED AEROPHONIC INSTRUMENT

(76) Inventor: William D. Morrison, 543 Wisp Creek Dr., Bailey, CO (US) 80421

( * ) Notice: Subject to any disclaimer, the term of this patent is extended or adjusted under 35 U.S.C. 154(b) by 0 days.

(21) Appl. No.: 12/113,840

(22) Filed: May 1, 2008

(51) Int. Cl.
*G10D 7/10* (2006.01)

(52) U.S. Cl. ..... 84/397; 84/453

(58) Field of Classification Search ..... 84/397, 84/453

See application file for complete search history.

(56) References Cited

U.S. PATENT DOCUMENTS

| | | | | |
|---|---|---|---|---|
| 869,033 | A | | 10/1907 | Viol |
| 942,429 | A | * | 12/1909 | Allen ..... 84/397 |
| 2,137,992 | A | | 11/1938 | Natoli |
| 3,625,104 | A | | 12/1971 | Amado |
| 3,635,118 | A | | 1/1972 | Slovacek, Jr. |
| 3,660,588 | A | | 5/1972 | Richardson |
| 4,016,794 | A | | 4/1977 | Brown |
| 4,069,734 | A | | 1/1978 | Colaianni |
| 4,766,797 | A | | 8/1988 | Jones |
| 6,838,603 | B2 | | 1/2005 | Wedgewood et al. |
| 2003/0121396 | A1 | | 7/2003 | Sheridan |

* cited by examiner

*Primary Examiner*—Jianchun Qin
(74) *Attorney, Agent, or Firm*—Kenneth H. Jack; Davis & Jack, L.L.C.

(57) ABSTRACT

An assembly for purging liquid from a lip vibrated aerophonic musical instrument having a hollow bore, the assembly including a first outlet port, the first outlet port opening the hollow bore of the lip vibrated aerophonic musical instrument; the assembly further having a housing having an inner wall and an inlet end; the assembly further having a second outlet port, the second outlet port opening the housing; the assembly further having a heat fusion weld attaching the housing to the lip vibrated aerophonic musical instrument, the weld positioning the housing's inlet end at the first outlet port; the assembly further including liquid transmissive materials; and the assembly further including an apertured screw cap operatively to an outlet end of the housing, the apertured screw cap being adapted for alternatively retaining the liquid transmissive material within the housing and releasing the liquid transmissive material from the housing.

7 Claims, 12 Drawing Sheets

ASSEMBLY FOR PURGING LIQUID FROM A LIP VIBRATED AEROPHONIC INSTRUMENT

FIELD OF THE INVENTION

This invention relates to lip vibrated musical instruments. More particularly, this invention relates to valving and porting of such instruments for liquid purging, particularly purging of accumulated saliva.

BACKGROUND OF THE INVENTION

Lip vibrated aerophonic musical instruments such as trombones and trumpets commonly accumulate, upon playing, liquid saliva within their hollow bores. Upon continuous prolonged playing, such saliva may undesirably accumulate at a low point within the bore of the instrument, typically at the bend of a trombone's slide or at the bend of a trumpet's tuning slide. Upon excess accumulations of saliva, the fluid may begin to interrupt and interfere with the clear sound and tone of the instrument. In order to compensate for such undesirable saliva accumulation, an outlet port opening the bore of the instrument at such low point fluid accumulation area is commonly provided. In order to preserve air pressure within the bore and to provide for sound reflection at such port, a valve commonly denominated as a "water key", is commonly installed upon the instrument at the outlet port. Such water key commonly comprises a toggle arm having a circular disk and a sealing pad at its port covering end, and an actuator arm at the other end, the toggle arm being pivotally mounted upon the instrument and being spring biased for normally covering the outlet port.

Such commonly known water key actuated saliva outlet assemblies impose multiple drawbacks and deficiencies. For example, in use of such commonly known assemblies, a musician may first become aware or may first determine that excess saliva has accumulated by audibly perceiving an interruption or degradation in the playing quality or tone of his or her instrument. Reliance upon such accumulation detection method undesirably causes the musician to repeatedly experience incidents of degraded playing quality. As another example, such commonly configured water key assemblies make it difficult for the musician to continue playing the instrument while purging saliva since actuation of the assembly occupies one of the musician's hands to operate the water key, and since the water key, upon opening, releases bore air pressure and interrupts sound reflection at the outlet port.

The instant inventive assembly for purging liquid from a lip vibrated aerophonic musical instrument solves or ameliorates the drawbacks and deficiencies discussed above by providing an attached housing structure having inlet and outlet ends, and by incorporating therein, liquid transmissive media and other structures for continuous fluid purging while continuously preserving bore air pressure and sound reflection.

BRIEF SUMMARY OF THE INVENTION

A first structural component of the instant inventive assembly for purging liquid from a lip vibrated aerophonic musical instrument comprises a first outlet port for liquid or salive emission. Where the first outlet port opens the bore of a trumpet, such port is typically positioned at the lower end of the trumpet's tuning slide. As a further example, where the first outlet port opens a trombone's bore, such port is typically positioned at the lower end of the bend of the trombone's slide. The first outlet port typically is circular and has a diameter between ⅛" and ¼". A further structural component of the instant inventive assembly comprises a housing having an inlet end, an outlet end, and having inner and outer wall surfaces. Preferably, the housing is cylindrical and has a circular cross-sectional profile. Suitably, the housing may be alternatively configured as a rectangular or square box structure.

A further structural component of the instant inventive assembly comprises a second outlet port for further liquid saliva emission, such port preferably opening the housing at the housing's outlet end. In the preferred embodiment of the instant invention, the second outlet port is, similarly with the first outlet port, circular and has a diameter between ⅛" and ¼".

First mounting means are preferably provided, the first mounting means fixedly attaching the housing to the lip vibrated aerophonic musical instrument, the first mounting means preferably positioning the housing's inlet end at the instrument's first outlet port for passage of saliva from the bore of the instrument into the hollow interior space of the housing. In a preferred embodiment of the instant invention, the inlet end of the circular cylindrical housing is "saddle" cut to match the typical outer peripheral shape of the tube to which the housing is to be attached. The housing may suitably be held in place upon the tube via a peripheral heat fusion weld, such welded mounting means positioning the housing's inlet end over the instrument's first outlet port. Suitably, the first mounting means may alternatively comprise a soldered bond or an adhesive bond, such bonding or attaching means similarly positioning the housing with respect to the instrument. Also suitably and alternatively, the first attaching means may comprise a helically threaded fitting, a snap-ridge and snap-channel fitting, or a lug and slide slot fitting. Any of such selected fittings preferably operatively and releasably interconnects the housing and the instrument at the site of the instrument's first outlet port.

In another advantageous embodiment of the instant invention, the first mounting means comprises and incorporates a conventional spring biased water key, such as is described above, the disk and sealing pad of such key compressively holding, in a spring biased fashion, the housing's inlet end over the instrument's first outlet port. Other commonly known means for operatively attaching the housing's inlet end at the site of the instrument's first outlet port are considered to fall within the scope of the instant invention.

A further structural component of the instant inventive assembly comprises a porous or liquid transmissive material, such material preferably being water insoluable. Suitably, the liquid transmissive material may comprise media such as foam rubber, elastomeric foam, ceramic foam, plastic foam, a mesh of metal fibers, a mesh of glass fibers, a mesh of fibrous organic material, or a stratification or wadding of woven fibers. Preferably, the liquid transmissive material, which is received within the housing, spans the entire entire interior space or diameter of the housing.

A further structural component of the instant inventive assembly comprises interchange means connected operatively to the housing, the interchange means being adapted for alternatively retaining the liquid transmissive material within the housing and releasing the liquid transmissive material from the housing. In a preferred embodiment of the instant inventive assembly, the interchange means comprises an apertured screw cap which is fitted for helically threaded engagement with helical threads provided at the outlet end of the housing. Such apertured screw cap advantageously holds the liquid transmissive material within the housing, while allowing saliva fluids flowing through the liquid transmissive material to emit outwardly through the aperture within the screw cap. In order to withdraw and dispose of old or soiled liquid transmissive material within the housing, a musician may manually disengage the screw cap from the housing, may extract the soiled liquid transmissive material from the housing utilizing, for example, tweezers, may interchange and insert new or clean liquid transmissive material, and may thereafter threadedly re-attach the screw cap. Suitably, the liquid transmissive media interchange means may alternatively comprise an apertured cap which in place of helically threaded fittings, utilizes a snap ridge and a snap channel attachment for releasable connection to the housing. Also, such interconnecting means may, as a further alternative to helical helically threaded fittings or snap ridges and snap channel fittings, comprise a lug and angled slide slot combination. Also, as a further alternative, the interchange means may comprise an internally fitted spring clip, such clip nesting within an inwardly opening channel within the inner wall of the housing at the housing's outlet end, such clip providing an annular ridge for retention of the liquid transmissive material.

As a further alternative, the interchange means may comprise a spring biased valve key assembly such as is described above, the sealing pad and plate of such key while holding the housing in place while additionally serving to removably and interchangeably hold the liquid transmissive material within the housing. Other commonly known means for interchangeably holding the liquid transmissive material within the housing are considered to fall within the scope of the instant invention.

Where the liquid transmissive material received within the hollow interior of the housing is sufficiently dense and is packed sufficiently close to the instrument's saliva emitting first outlet port, such material itself may provide sound wave reflection at the site of the port sufficient to preserve tonal qualities of the instrument. However, where additional sound reflection is desired, a sound reflector plate may be provided within the housing, such plate having a surface area sufficient to co-extensively underlie the first outlet port. Where such a plate is provided, reflector plate mounting means are also preferably provided for suspending the reflector plate immediately beneath the first outlet port. Preferably, the reflector plate mounting means comprises a plurality of upwardly angled and outwardly extending wall biasing arms, such arms being fixedly attached to or formed wholly with the reflector plate. Other means for positioning and suspending the reflector plate beneath the instrument's first outlet port such as a series of reflector plate supporting legs which rest upon the liquid transmissive media are considered to fall within the scope of the invention.

In use of the inventive assembly for purging liquid from a lip vibrated aerophonic musical instrument, continuous instrument playing is facilitated via continuous outward flow and continuous purging of saliva through the first outlet port, thence through the liquid transmissive material, and thence further outwardly from the housing at the housing's fluid outlet end. Simultaneously with the liquid purging, air pressure within the bore of the instrument is maintained by the liquid transmissive material while sound reflection is provided by the liquid transmissive material or, alternatively, a sound reflector plate. In the event that the liquid transmissive material becomes soiled or degraded, the musician may utilize the invention's interchange means to facilitate extraction of the liquid transmissive material and reinsertion and re-retention of new or cleaned liquid transmissive material.

Accordingly, it is an object of the instant invention to provide an assembly for purging liquid from a lip vibrated aerophonic musical instrument which facilitates continuous and hands-free liquid and saliva purging, which facilitates sound reflection and air pressure retention during such continuous liquid purging, and which facilitates interchange and replacement of old or soiled liquid transmissive material contained and received within the assembly.

Other and further objects, benefits, and advantages of the instant invention have been described above and are further described in the Detailed Description which follows, and in the appended drawings.

DETAILED DESCRIPTION OF SELECTED PREFERRED EMBODIMENTS

Figure 1:
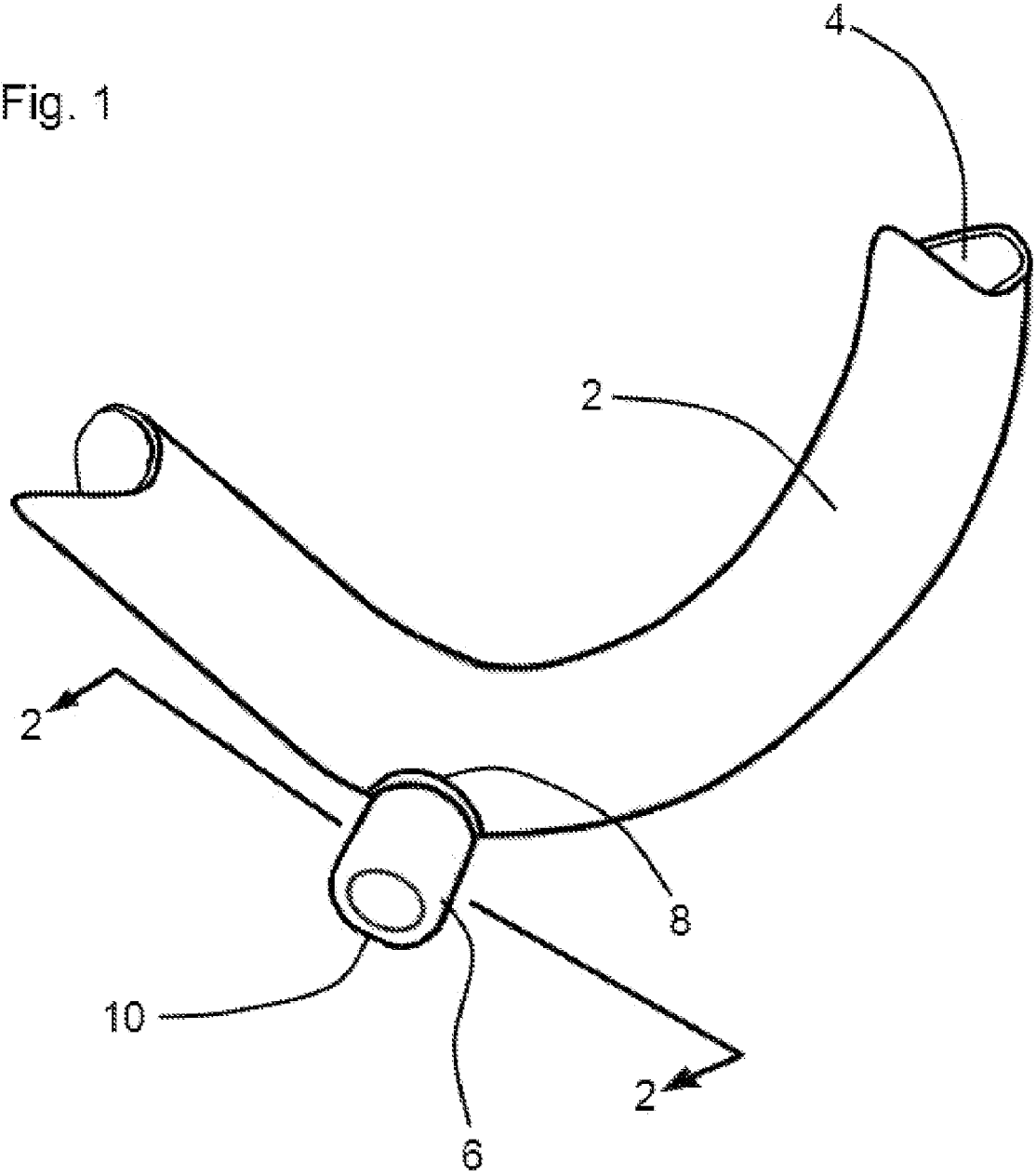
FIG. 1 is a perspective view of a preferred embodiment of the instant inventive assembly for purging liquid from a lip vibrated aero-phonic musical instrument.

Referring now to the drawings, and in particular to FIG. 1, the depicted tube 2 is representative of the bend of a tube of a lip vibrated aero-phonic musical instrument such as the tuning slide of a coronet or a trumpet or the extreme distal end of a trombone's slide. The tube 2 has a hollow bore 4 and, referring further simultaneously to FIG. 2, a first saliva outlet port 12. A circular cylindrical housing 6 is provided, such housing having a ceiling 15. A saliva inlet aperture 14 which preferably matches the first outlet port 12, a lower second outlet port 10, and interchange means 22 and 24.

Figure 2:
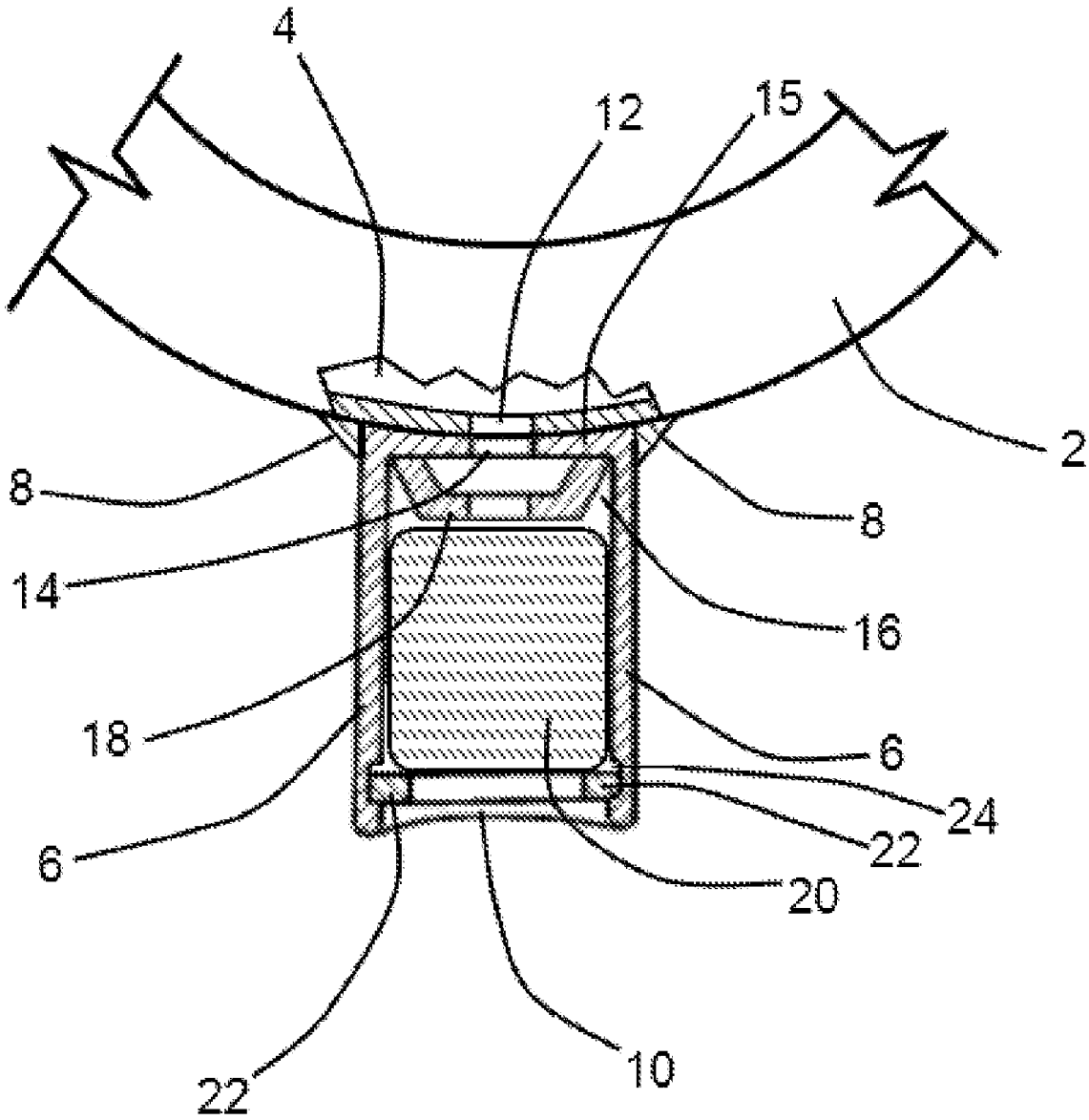
FIG. 2 is a partial sectional view as indicated in FIG. 1.

Referring further simultaneously to FIGS. 1 and 2, first mounting means 8 are preferably provided, such means interconnecting the housing 6 and the tube 2; such means preferably positioning the housing's inlet port 14 over the tube's first outlet port 12. The mounting means 8, as depicted, is representative of welded or heat fusion bonds, soldered bonds, adhesive bonds, pressure fitted bonds, helically threaded fittings, snap-ridge and snap-channel fittings, and lug and slide slot fittings. The interchange means 22 and 24, as depicted in FIGS. 1 and 2, comprises an annular inwardly opening spring clip receiving channel 24, such channel receiving a compressively fitted spring clip 22. The spring clip 22 rests within the channel 24 and retains within the hollow interior 16 of the housing 6 a liquid transmissive media 20, such media being representative of porous water insoluable foam rubber, elastomeric foam, ceramic foam, plastic foam, metal fibers, fibrous organic material, and woven fibers. Depending upon the density of and the upper surface configuration of the liquid transmissive media 20, such media may sufficiently provide sound reflection at and through apertures 12 and 14 for preservation of the tonal qualities of the instrument. Where enhanced sound reflection is desired, referring further simultaneously to FIG. 3, a metal or plastic sound reflector 18 may be provided. The reflector 18 preferably has upwardly and outwardly wall biasing arms for an interference or pressure fitted mount of the sound reflector immediately beneath ports 12 and 14.

Figure 3:
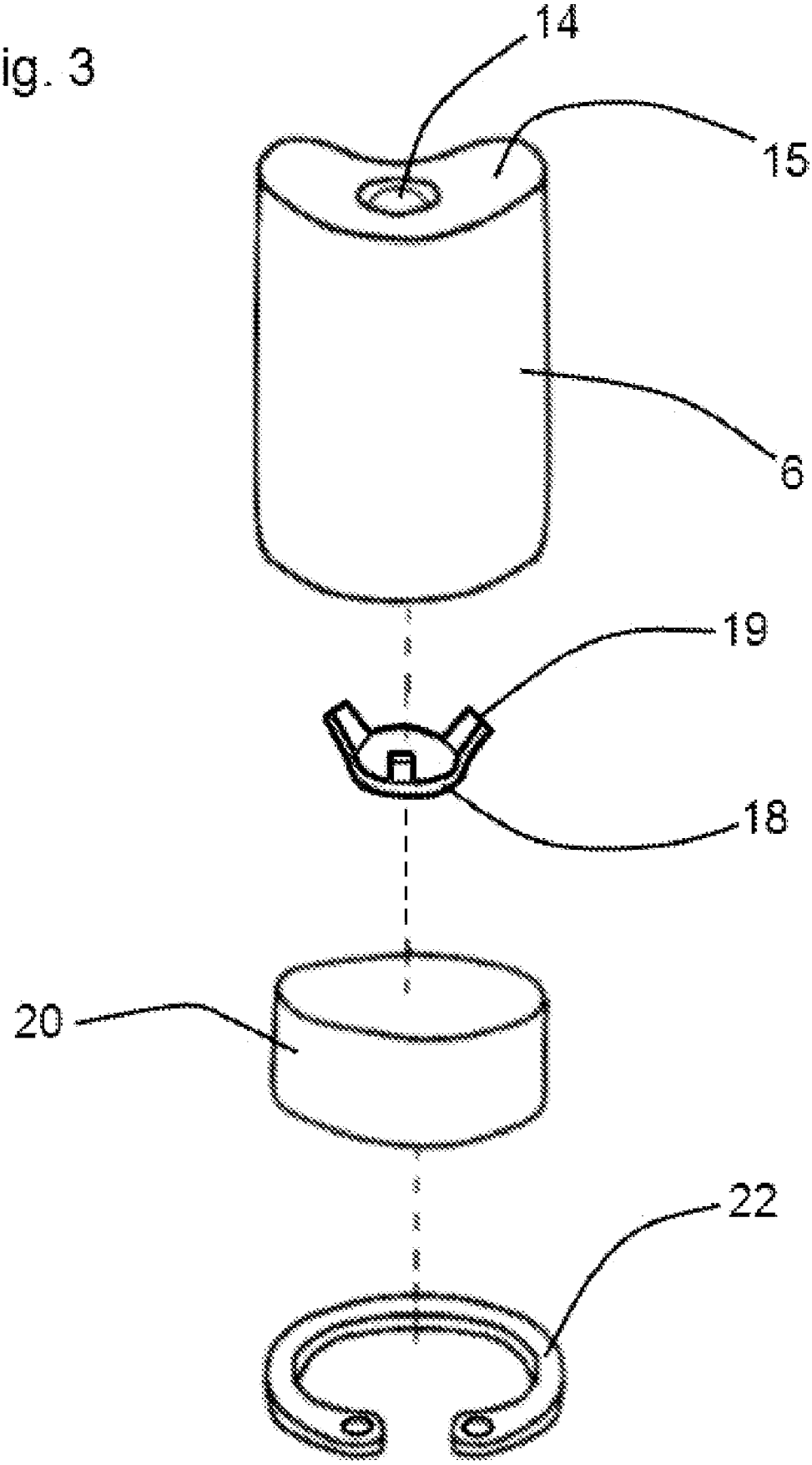
FIG. 3 is a partial exploded view of the assembly depicted in FIG. 1.

In operation of the instant inventive assembly, referring simultaneously to FIGS. 2 and 3, the sound reflector 18 may be fictionally driven upwardly through the second outlet port 10, and thence along the hollow bore 16 of the housing 6 to reach a fixed sound reflecting position beneath ports 12 and 14, as depicted in FIG. 2. Thereafter, the liquid transmissive media may be similarly upwardly inserted into such bore 16 to the position depicted in FIG. 2. Thereafter, spring clip 22 may be compressed through use of a spring clip insertion and removal tool (not depicted), and such clip may be compressively mounted within channel 24, as depicted in FIG. 2. Upon assembly of the components depicted in FIG. 2, the spring clip 22 advantageously provides a shelf for retaining the liquid transmissive media 20 within the hollow bore 16 of the housing 6.

Upon playing of the lip vibrated aero-phonic musical instrument represented in FIG. 2, saliva may flow along the bore 4 of the tube 2 to outwardly emit through the first outlet port 12, and thence enter the hollow interior space 16 of the housing 2 through port 14. Such saliva then may flow into and be drawn, by capillary action into the liquid transmissive media 20. Upon continued playing of the instrument, air pressure within the bore 4 of the tube 2 is advantageously maintained by the fluid soaked liquid transmissive media 20, such air pressure also progressively driving the fluid downwardly through the media 20 to emit through outlet port 10. Simultaneously with such fluid purging and air pressure maintaining effects, the sound reflector 18 advantageously reflects sound waves through ports 12 and 14.

Referring further simultaneously to FIGS. 1-3, the liquid transmissive media interchange means consisting of spring ring 22 and the channel 24 combination may be further operated to inwardly contract and downwardly withdraw the ring 22, and to thereafter withdraw the media 20 from the interior 16 of the housing 6. Such media may then be either disposed of and replaced or washed and returned into the interior 16 of the housing 6.

Figure 4:
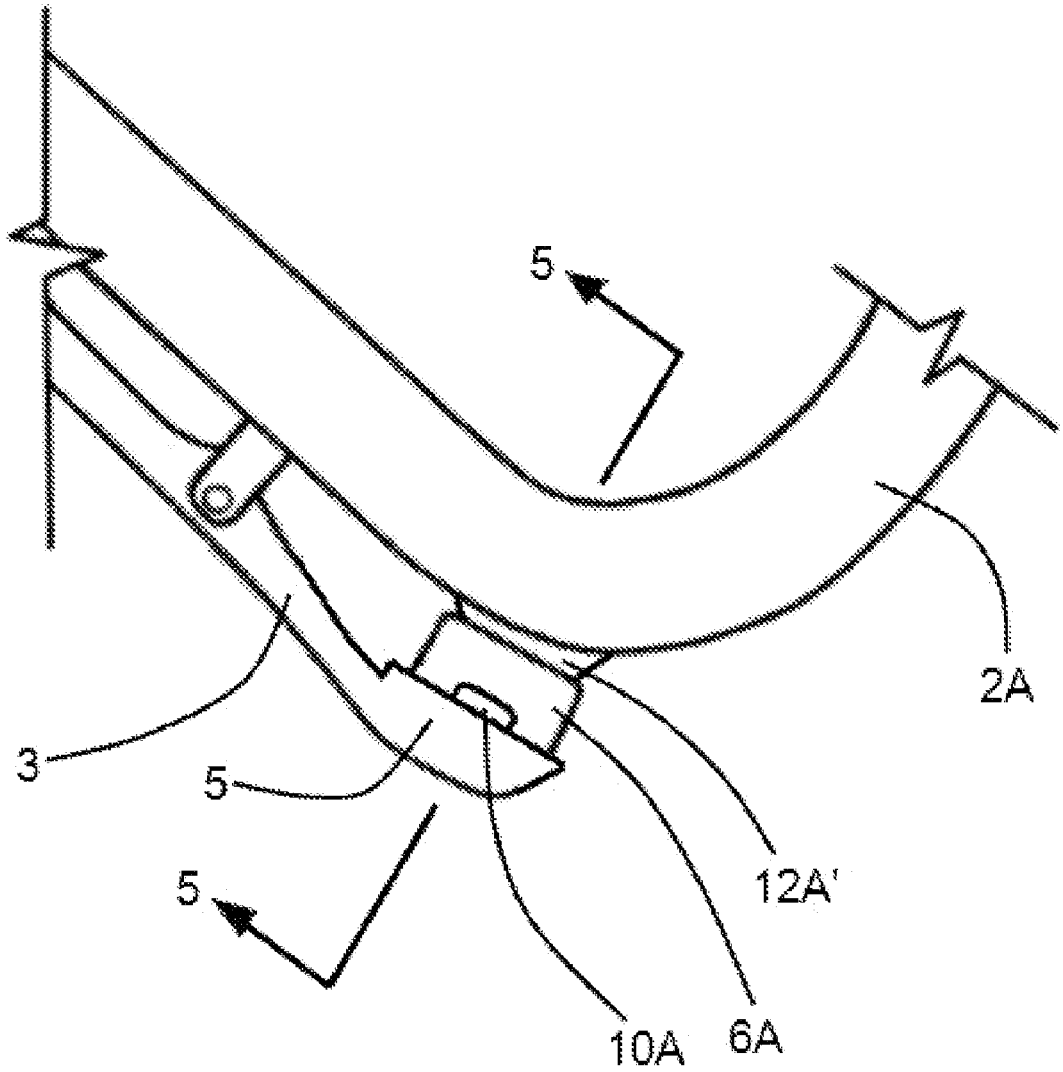
FIG. 4 presents an alternative configuration of the instant inventive assembly.
Figure 5:
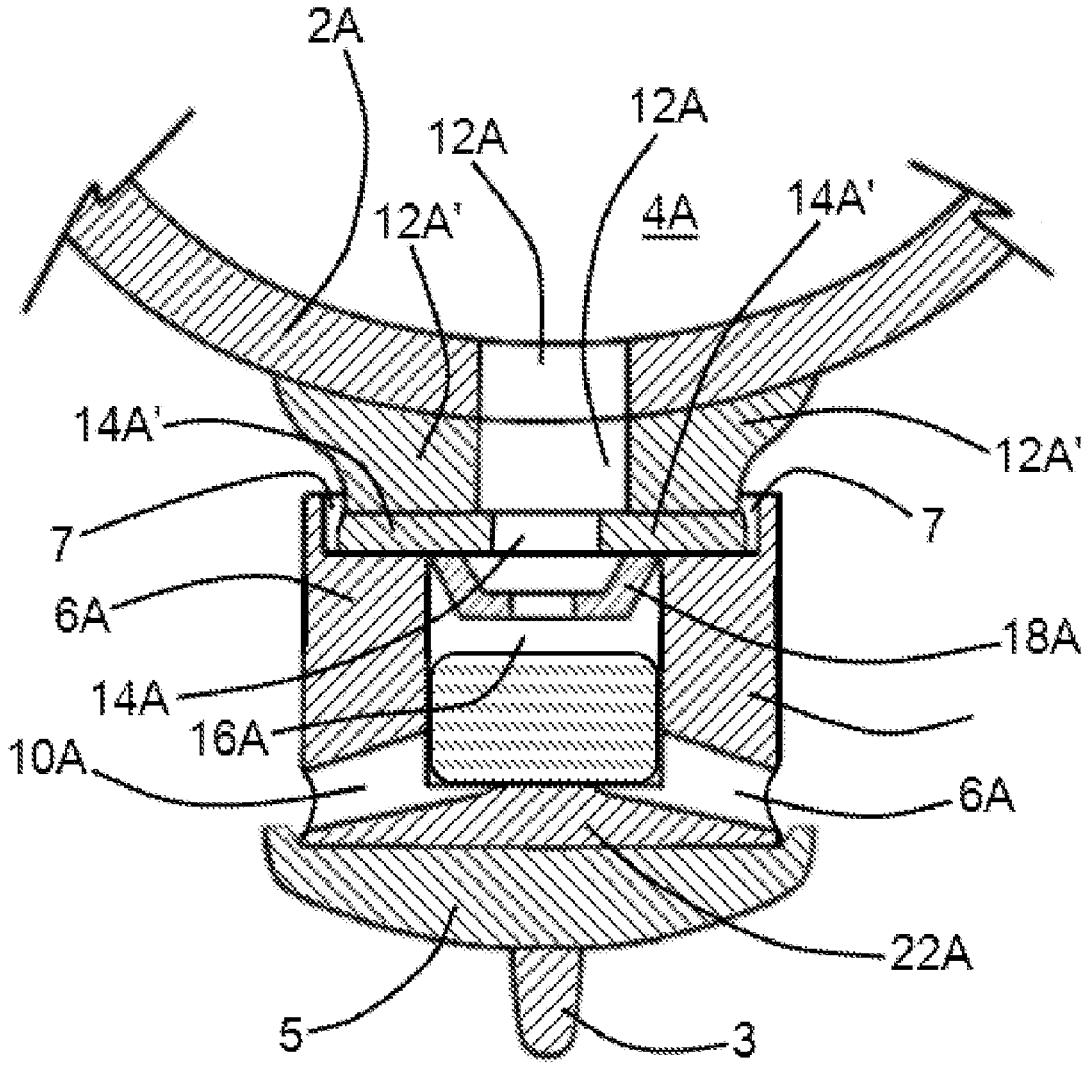
FIG. 5 is a partial sectional view as indicated in FIG. 4.
Figure 6:
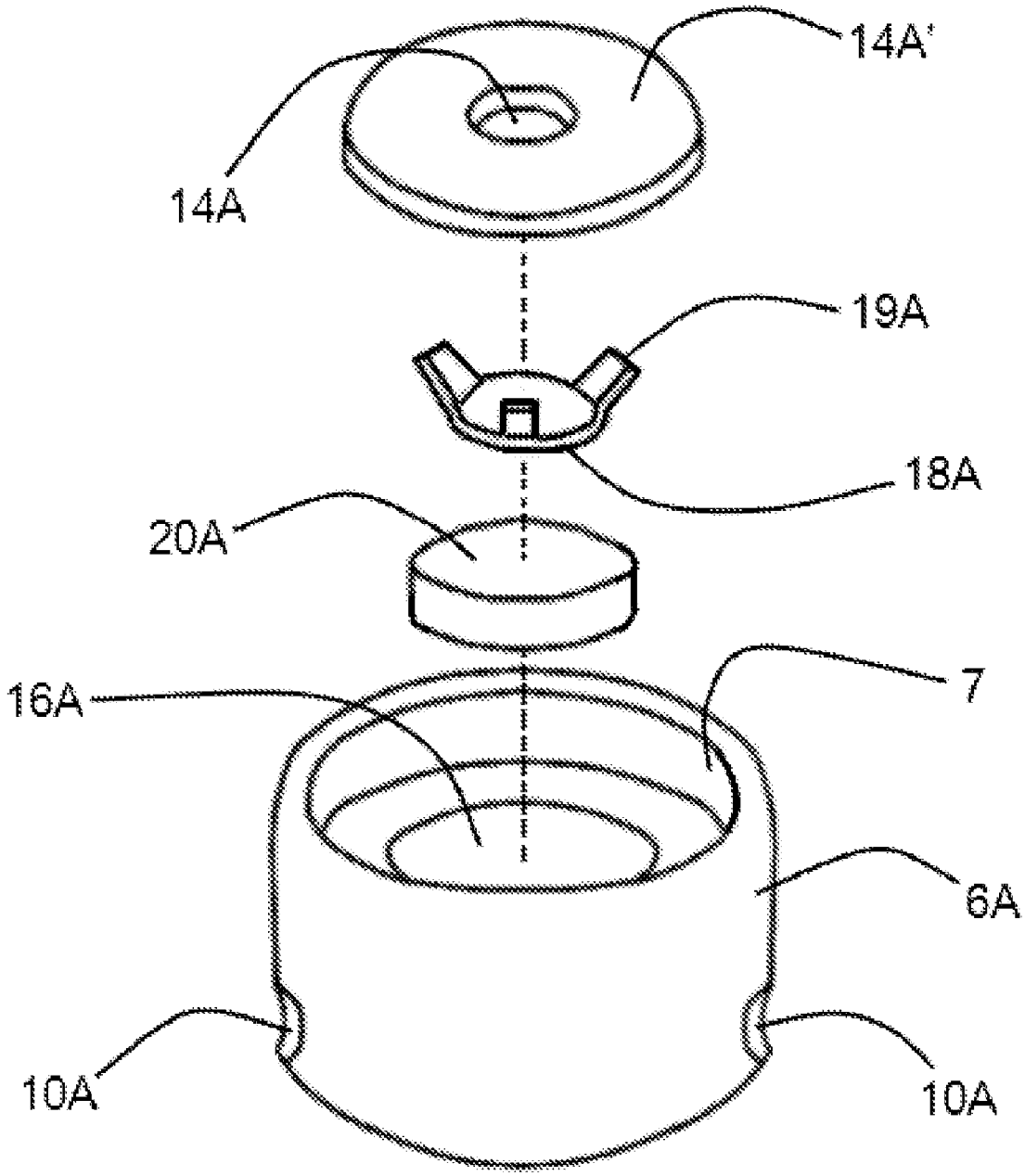
FIG. 6 is a partial exploded view of the assembly of FIG. 4.

Drawing FIGS. 4-6 are representative of an alternative embodiment of the instant inventive assembly for purging liquid from a lip vibrated aero-phonic musical instrument. In FIG. 4, Reference Numeral 2A denotes a tuning slide tube of a trumpet or coronet or an extreme distal end of a trombone's slide. Such tube 2A has an interior bore 4A, and a first saliva outlet port 12A, such port 12A communicating with a short saliva port nipple 12A'. A spring biased water valve toggle key 3 having a circular valve head 5 normally covers the nipple 12A for retaining accumulated saliva within the bore of the tube 2A until toggle key 3 is depressed and saliva is thereby allowed to emit through saliva outlet port 12A. Typically, continued playing of the instrument is interrupted during such saliva purging operation, and between such purging operations, accumulated saliva within the bore of the tube 2A may threaten to degrade with the tone quality of the instrument. In order to associate the function of the assembly of FIGS. 1-3 with such traditional toggle key 3 and saliva port 12A, a circular cylindrical housing 6A is provided, much like the cylindrical housing 6 of FIGS. 1-3. The circular cylindrical housing 6A has an upper recess 7 and a hollow interior 16A which upwardly communicates with the recess 7. Laterally extending outlet ports 10A at the lower end 22A of the cylindrical housing 6A communicate with the lower end of such housing's interior 16A. Liquid transmissive media 20A within the interior 16A functions in much the same manner as the media 20 discussed above in relation to the assembly of FIGS. 1-3. Similarly, a sound reflector plate 18A having spring arms 19A functions in much the same manner as the sound reflector plate 18 discussed above in relation to FIGS. 1-3. A circular disk 14A' having a central aperture 14A may be advantageously interposed between the nipple 12A' and the recess 7 of the housing 6A.

In operation of the assembly of FIGS. 4-6, the normally closed spring biased toggle valve 3 and 5 dually functions as a mounting means for holding the cylindrical housing 6A in communication with nipple 12A, and as a liquid transmissive media interchange means. Upon assembly as configured as in FIG. 4, the housing 6A is securely held in place by the spring of the toggle. Upon depression of the rearward lever arm of the toggle 3, housing 6A may be extracted and the media 20A may be easily and conveniently changed or cleaned, the assembly thereafter being reassembled for use.

Figure 7:
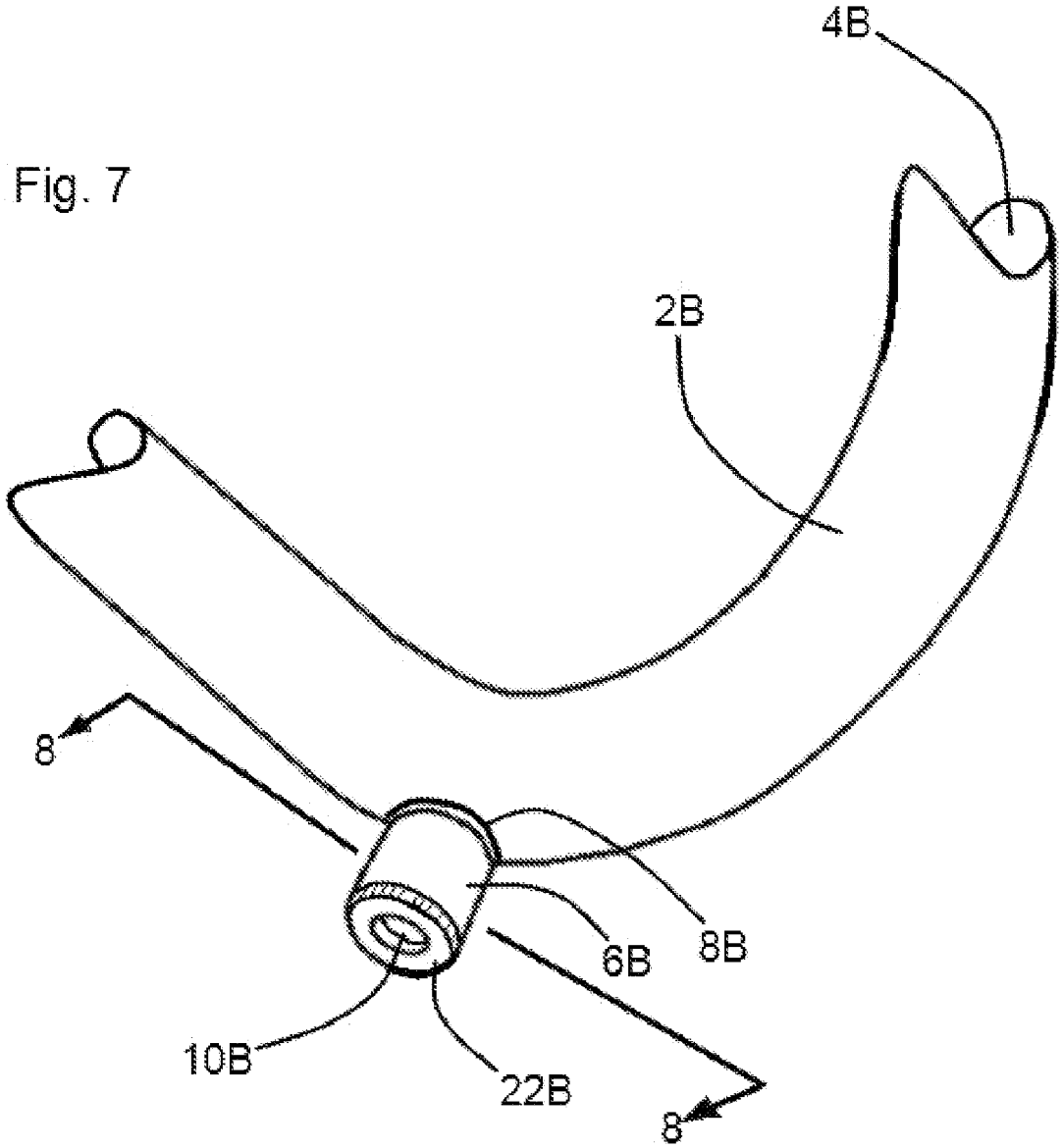
FIG. 7 presents an alternative configuration of the assembly of FIG. 1.
Figure 8:
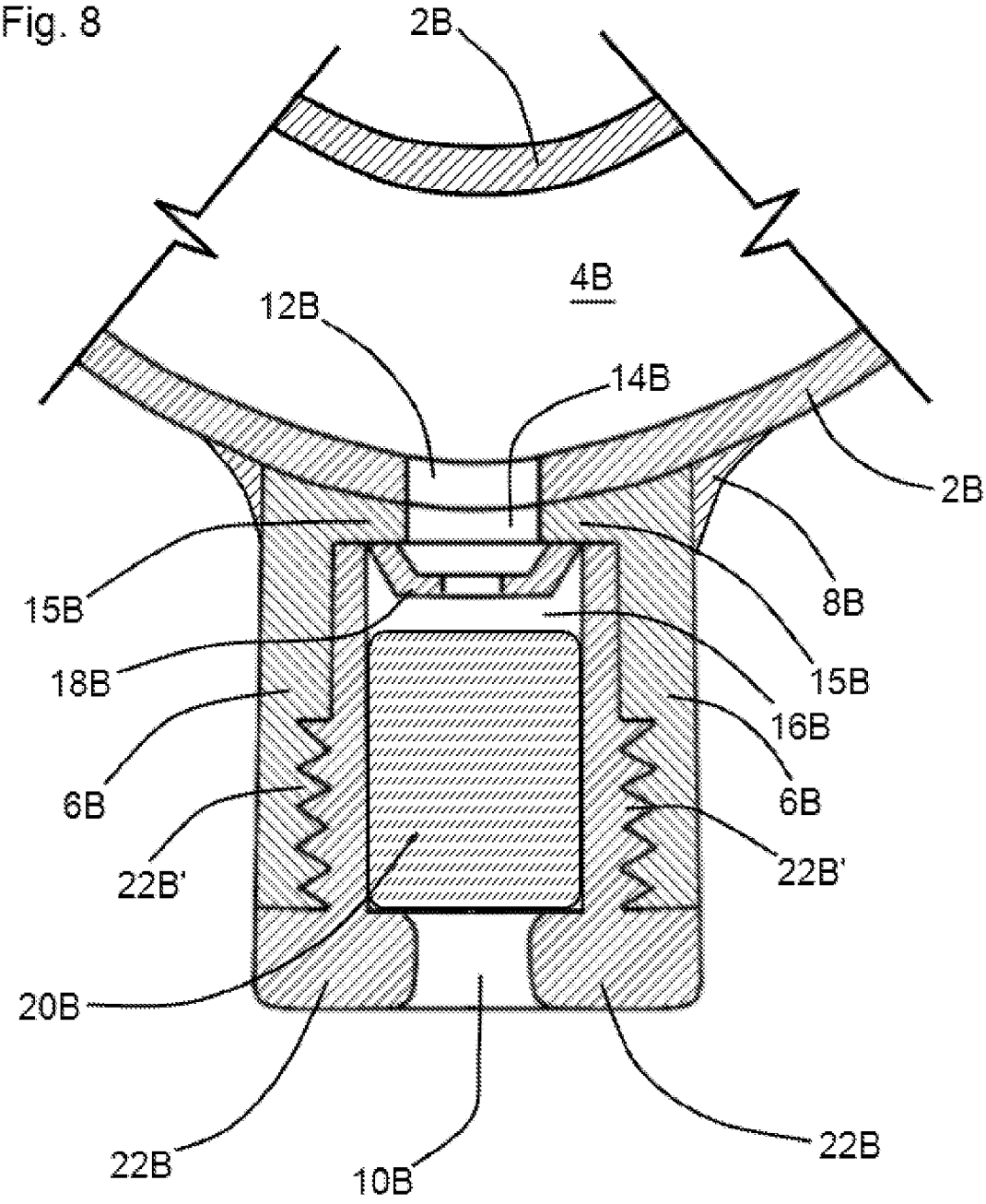
FIG. 8 is a partial sectional view of the assembly of FIG. 7.
Figure 9:
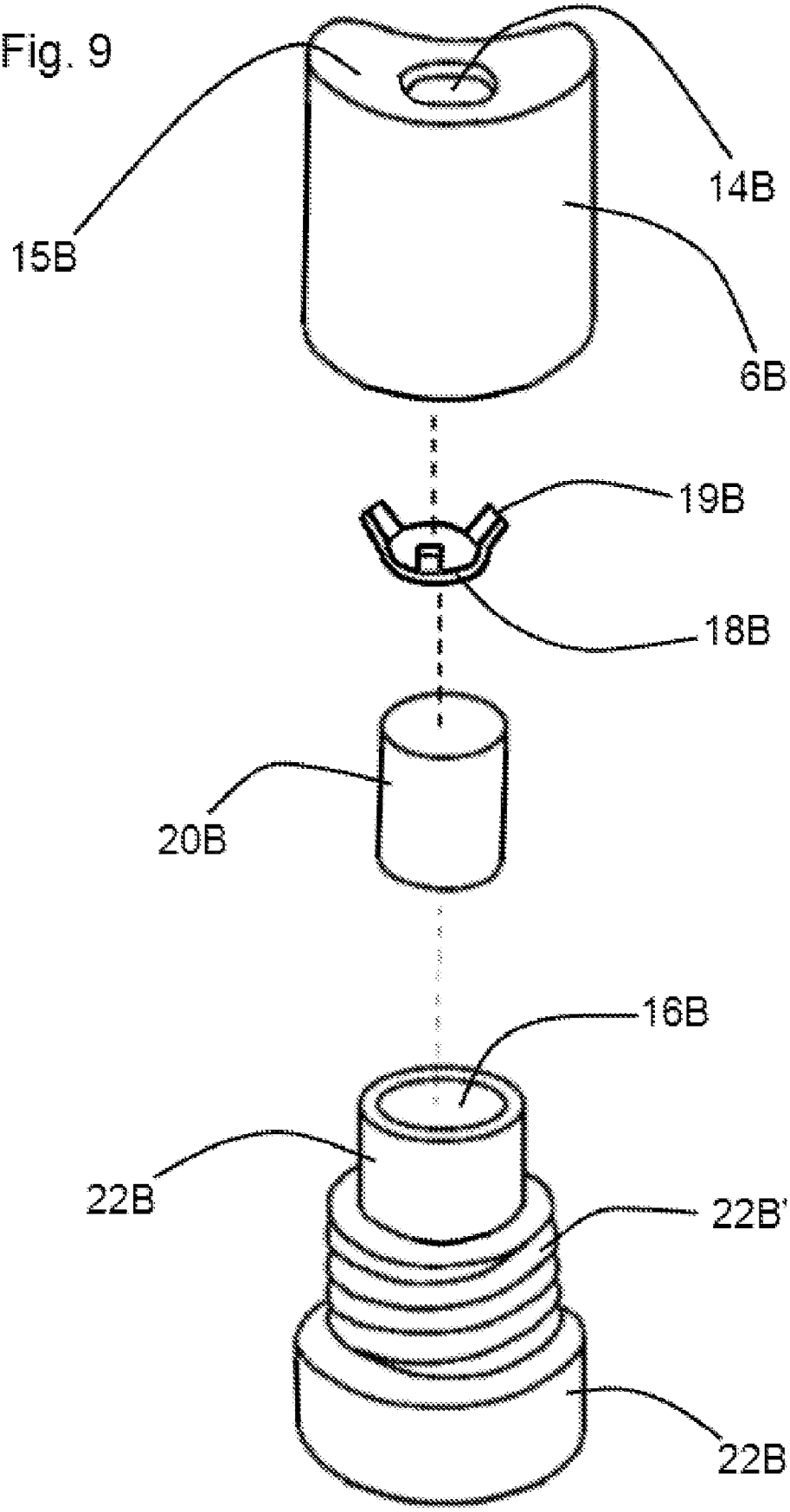
FIG. 9 is a partial exploded view of the assembly of FIG. 7.

FIGS. 7-9 represents an assembly configuration that is a further alternative to the configuration of FIGS. 1-3. In FIGS. 7-9, structures identified by reference numerals having the suffix "B" are substantially identical in structure and function to similarly numbered reference numerals appearing in FIGS. 1-3. In the configuration of FIGS. 7-9, the liquid transmissive medial interchange means constitutes helical threads 22B which removably hold a cap insert 22B within the circular cylindrical housing 6B.

Figure 10:
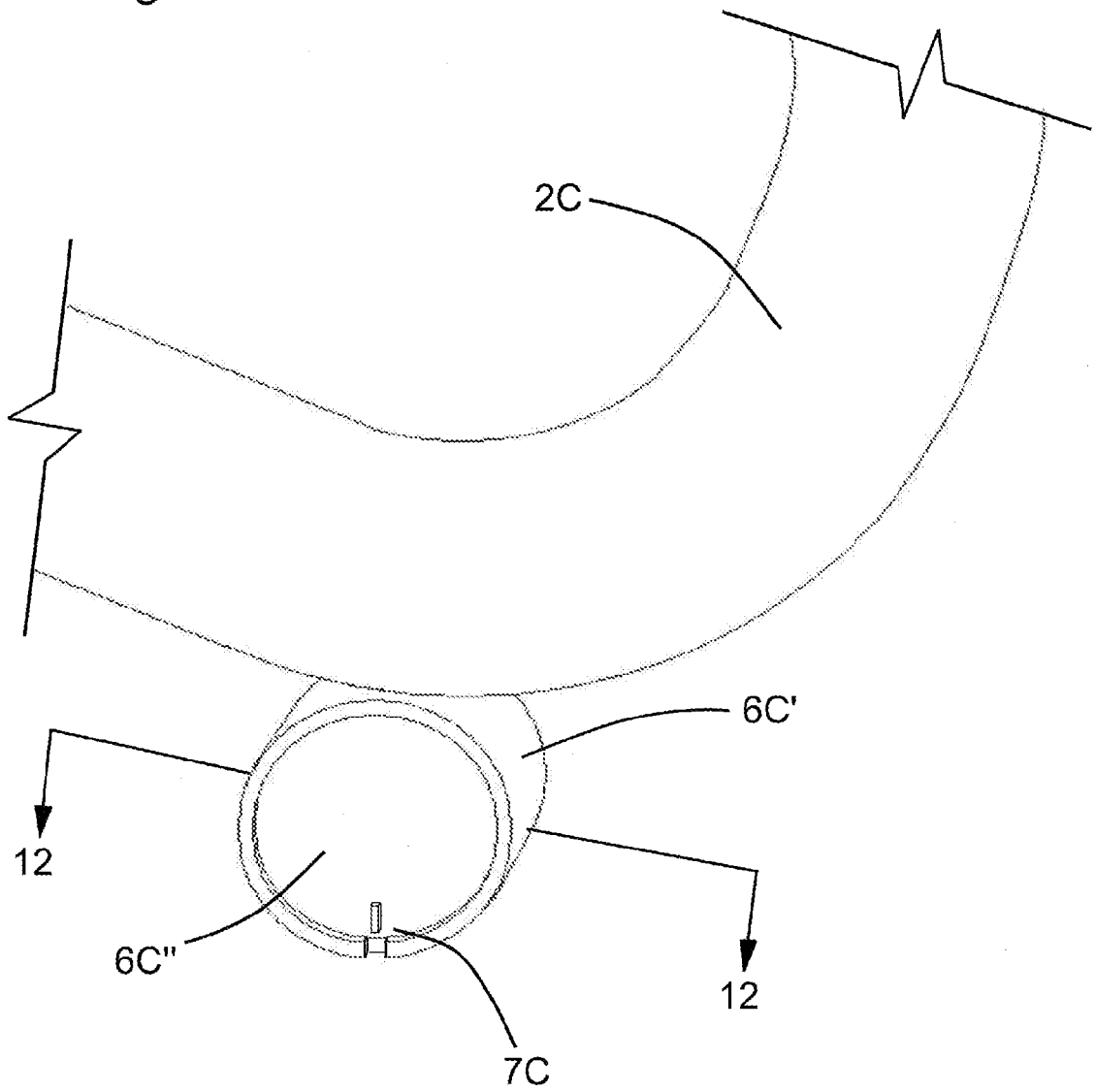
FIG. 10 presents a further alternative configuration of the instant inventive assembly.
Figure 11:
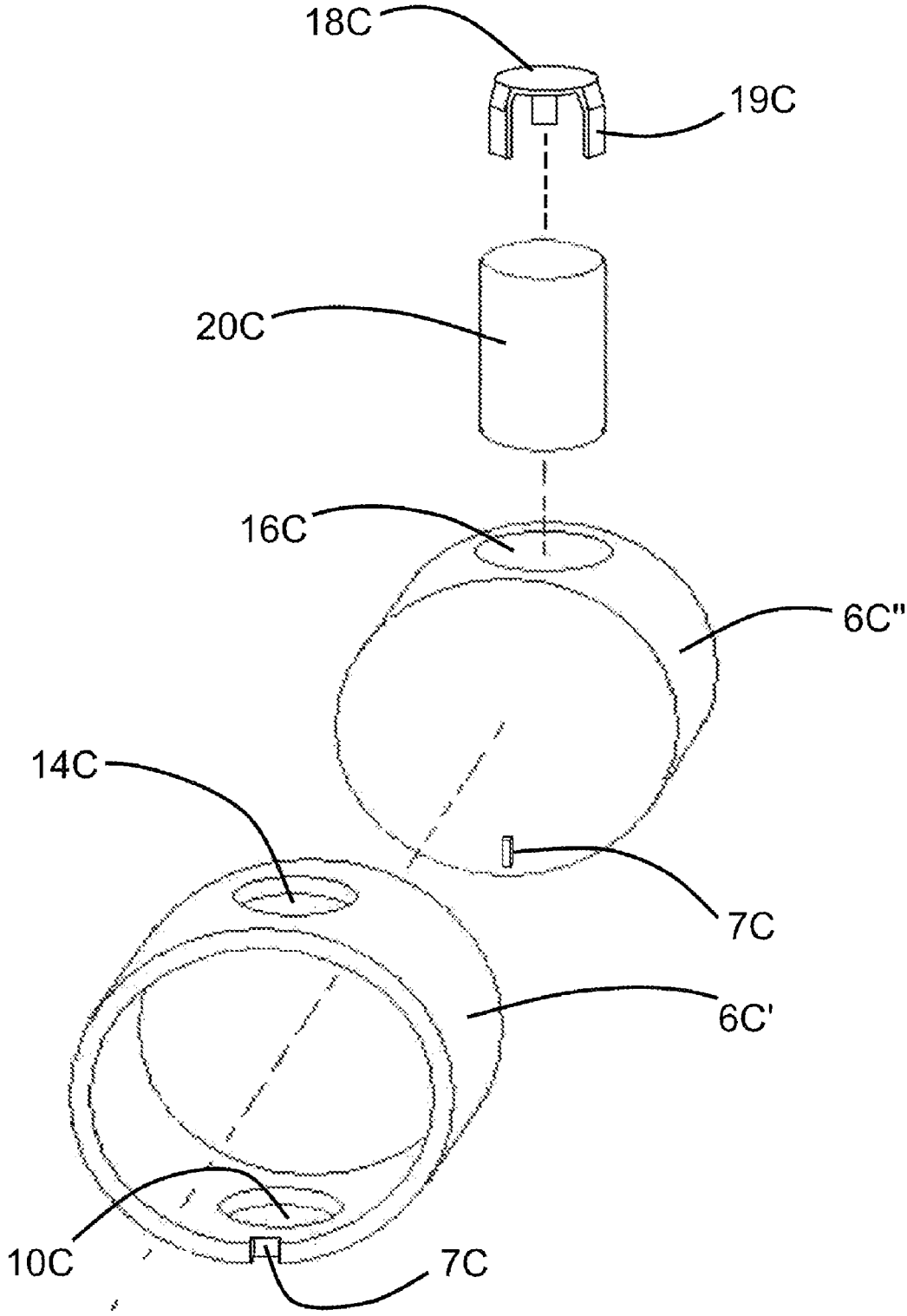
FIG. 11 is an exploded view of a portion of the assembly of FIG. 10.
Figure 12:
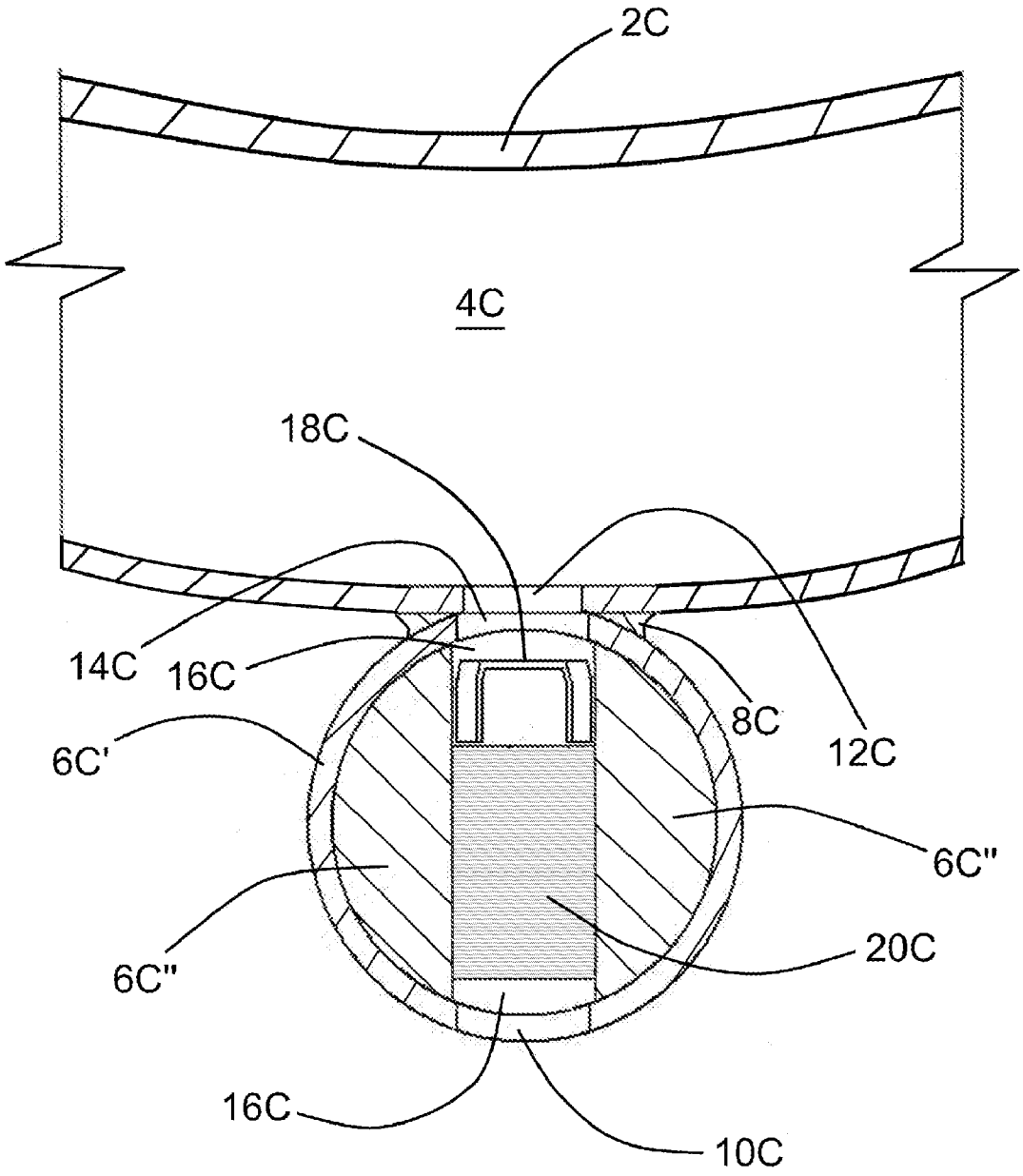
FIG. 12 is a sectional view of the assembly as indicated in FIG. 10.

FIGS. 10-12 represent a further advantageous alternative configuration of the instant inventive assembly for purging liquid from a lip vibrated aero-phonic musical instrument. As with prior figures, Reference Numeral 2C denotes, for example, a tuning slide of a trumpet or a coronet, such tube having a hollow interior bore 4C and a first saliva outlet port 12C. In contrast with the configurations depicted in FIGS. 1-9, the circular cylindrical housing component 6C' and 6V" is positioned transversely with respect to the tube 2C, rather than end on. The transverse cylinder 6C' and 6C" preferably is fixedly attached to the tube 2C by welds 8C. The transversely positioned cylindrical housing 6C' and 6C" and has an upper saliva inlet port 14C, a lower saliva outlet port 10C. The interior component 6C" of the cylindrical housing preferably comprises a plastic disk which is closely fitted for nesting receipt within cylinder 6C'. A hollow bore 16C extends through the disk 6C", the diameter of such bore preferably being greater than the diameter of the output port 10C. As the result of such relationship of structural diameters, the peripheral edge of port 10C advantageously functions as means for retaining the liquid transmissive media 20C within the bore 16C. Referring simultaneously to FIGS. 10-12, it may be seen that the internal component 6C" may slidably and rotatably move with respect to the external component 6C'. Such motion may advantageously cause the components 6C' and 6C" so function together as a valve for alternatively opening and closing port 14C. Preferably, a tactile open or flow through position indicator 7C is provided.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for purging liquid from a lip vibrated aerophonic musical instrument, said instrument having a hollow bore, the assembly comprising:

(a) a first outlet port, said port opening the lip vibrated aerophonic musical instrument's hollow bore;

(b) a housing having an inner wall and an inlet end, the housing comprising a first hollow bored cylinder;

(c) a second outlet port, the second outlet port opening the housing;

(d) first mounting means attaching the housing to the lip vibrated aerophonic musical instrument, the first mounting means positioning the housing's inlet end at the first outlet port;

(e) liquid transmissive material; and (f) interchange means connected operatively to the housing, the interchange means being adapted for alternatively retaining the liquid transmissive material within the housing and releasing the liquid transmissive material from the housing; the housing further comprising a second hollow bored cylinder nestingly mounted within first hollow bored cylinder, the second hollow bored cylinder defining a liquid transmissive material receiving space within the housing.

2. The assembly of claim 1 wherein the first mounting means comprises a connector selected from the group consisting of heat fusion bonds, soldered bonds, adhesive bonds, pressure fitted bonds, helically threaded fittings, snap ridge and snap channel fittings, lug and slide slot fittings, and water key clamped attachments.

3. The assembly of claim 2 wherein the liquid transmissive material comprises porous water-insoluable media.

4. The assembly of claim 3 wherein the porous water-insoluable media comprises a material selected from the group consisting of foam rubber, elastomeric foam, ceramic foam, plastic foam, metal fibers, glass fibers, fibrous organic material, and woven fibers.

5. The assembly of claim 1 further comprising a sound reflecting plate and reflector mounting means, the reflector mounting means positioning the sound reflecting plate within the housing, the reflector mounting means further positioning the sound reflecting plate beneath the first outlet port.

6. The assembly of claim 5 wherein the sound reflector mounting means comprises a plurality of arms fixedly attached to or formed wholly with the sound reflecting plate.

7. The assembly of claim 1 wherein the interchange means comprises an outlet port lining edge surface.

* * * * *